US006007653A

United States Patent [19]

Pirinen et al.

[11] Patent Number: 6,007,653

[45] Date of Patent: Dec. 28, 1999

[54] MANUFACTURING METHOD AND NONWOVEN MATERIAL

[75] Inventors: Pentti Pirinen, Valkeakoski; Tapio Niemi, Kotka, both of Finland

[73] Assignee: UPM-Kymmene OYJ, Valkeakoski, Finland

[21] Appl. No.: 08/952,936

[22] PCT Filed: May 31, 1996

[86] PCT No.: PCT/FI96/00314

§ 371 Date: Nov. 26, 1997

§ 102(e) Date: Nov. 26, 1997

[87] PCT Pub. No.: WO96/39553

PCT Pub. Date: Dec. 12, 1996

[30] Foreign Application Priority Data

Jun. 6, 1995 [FI] Finland ..... 952754

[51] Int. Cl.[6] ..... D04H 1/00; D04H 5/02

[52] U.S. Cl. ..... 156/148; 264/109; 264/122; 28/104; 156/62.2

[58] Field of Search ..... 156/62.2, 148; 264/109, 122; 28/104, 107; 442/384, 387, 405, 408, 411

[56] References Cited

U.S. PATENT DOCUMENTS

| | | | |
|---|---|---|---|
| 4,375,448 | 3/1983 | Appel et al. . | |
| 4,377,543 | 3/1983 | Strohbeen et al. . | |
| 4,741,075 | 5/1988 | Taguchi et al. | 28/104 |
| 5,375,306 | 12/1994 | Roussin-Moynier | 28/104 |
| 5,431,991 | 7/1995 | Quantiille et al. . | |
| 5,656,333 | 8/1997 | Truong et al. . | |
| 5,733,635 | 3/1998 | Terakawa et al. . | |

FOREIGN PATENT DOCUMENTS

| | | |
|---|---|---|
| 0 491 383 A1 | 6/1992 | European Pat. Off. . |
| 0 333 209 B1 | 9/1994 | European Pat. Off. . |
| 1596718 | 8/1981 | United Kingdom . |

*Primary Examiner*—Sam Chuan Yao

*Attorney, Agent, or Firm*—Pollock, Vande Sande & Amernick

[57] ABSTRACT

A method of making a nonwoven material having good absorbency, softness and strength. A fibrous web is airlayed from fibers comprising at least one of natural fibers and rayon fibers. The web is prebonded by sequentially adding moisture on an upper surface of the web and on a lower surface of the web. The web is calendered with a heated roll a first time after adding moisture on the upper surface of the web and calendered with a heated roll a second time after adding moisture on the lower surface of the web. The web is then spunlaced.

10 Claims, 1 Drawing Sheet

MANUFACTURING METHOD AND NONWOVEN MATERIAL

FILED OF THE INVENTION

This invention relates to a manufacturing method of nonwoven materials where a web is formed using an air laying method after which the web is both prebonded and hydro entangled, and to a nonwoven material manufactured according to the method. More particularly, this invention relates to nonwoven materials made from natural fibers such as wood fiber or from natural fibers and plastic fibers. The nonwoven materials have good absorbency, softness and strength properties. Particularly, but not exclusively, this invention relates to a nonwoven material which can be used for wet wipes or for the surface layers of absorbent disposables such as childrens' diapers, feminine pads and incontinence products, among others.

BACKGROUND OF THE INVENTION

In the manufacture of air laid nonwoven materials, natural fibers are used to form a web onto which a bonding agent or bonding fibers are applied which under the influence of heat bind the formed web into a porous material layer. Such layers are formed on top of each other including as many as the desired thickness of the product requires. Material layers produced as described are used in the manufacture of various table top, hygiene, hospital and wipe products. The problem with these types of products, however, is their often inadequate strength, resulting in breaking of the products or deleterious dusting of fibers.

In the manufacture of spunlaced nonwoven material, the fibrous structure is created by using fine water jets to entangle the fibers of a fibrous web with each other. These jets are directed at the fibrous layer supported by a liquid permeable wire moving in a specific speed. When the fibers pass under the jets, the liquid jets penetrating the layer impinge the fibers. The joint influence of this and of the jets reaching the wire causes the fibers to entangle with each other. This method can be used to produce nonwoven fabrics from fibers of different origin selected on the basis of their intended usage, as long as the fibers minimum length is adequate. However, the problem with this type of a process is often that short fibers are flushed out or that they pass through the wire, which causes fiber loss, cleaning problems and extra costs.

SUMMARY OF THE INVENTION

This invention relates to a method that can be used to create from low-cost raw materials a nonwoven material with good absorbency, softness and strength and that, if necessary, can be manufactured so that it decomposes quickly, for example, in a natural environment. A method according to the present invention is characterized in that the manufacture of the nonwoven comprises the following stages:

- A fibrous web is air laid from natural fibers, such as wood fibers or a blend of natural fibers and bonding fibers;
- The fibrous web is prebonded either by using bonding fibers and heat, or by applying a liquid bonding agent to the fibrous web and bonding it with thermal bonding, or by moisturizing the fibrous web and bonding it with heated calenders;
- The fibrous web is spunlaced.

Thus a low-cost nonwoven according to the present invention is produced stage-by stage in a production line that comprises the aforesaid stages. Good absorbency, softness and low raw material costs are based on the large proportion of wood fibers. Extremely good biodegradability can be achieved by using merely wood fiber, such as mechanical or chemical pulp, and in addition, if necessary, a small amount of rayon fiber. To the surprise of the applicant, prebonding prevents fibers from flushing during spunlacing. Spunlacing produces the good strength of the web while maintaining good absorbency and softness.

Thus, the surprising result is that the nonwoven produced is absorbent, soft and strong. Raw material costs of the nonwoven are low and the nonwoven can be manufactured, if necessary, so that it has very good biodegradability.

Other preferred embodiments of the method according to the present invention are characterized by what is stated in the claims. A nonwoven material according to the present invention and its preferred embodiments are also characterized by what is stated in the claims.

BRIEF DESCRIPTION OF THE FIGURE

The invention is described with the help of the following example with reference to the attached drawing, FIG. 1, presenting a production line of a nonwoven according to the present invention.

DETAILED DESCRIPTION OF THE PREFERRED EMBODIMENTS

Figure 1:
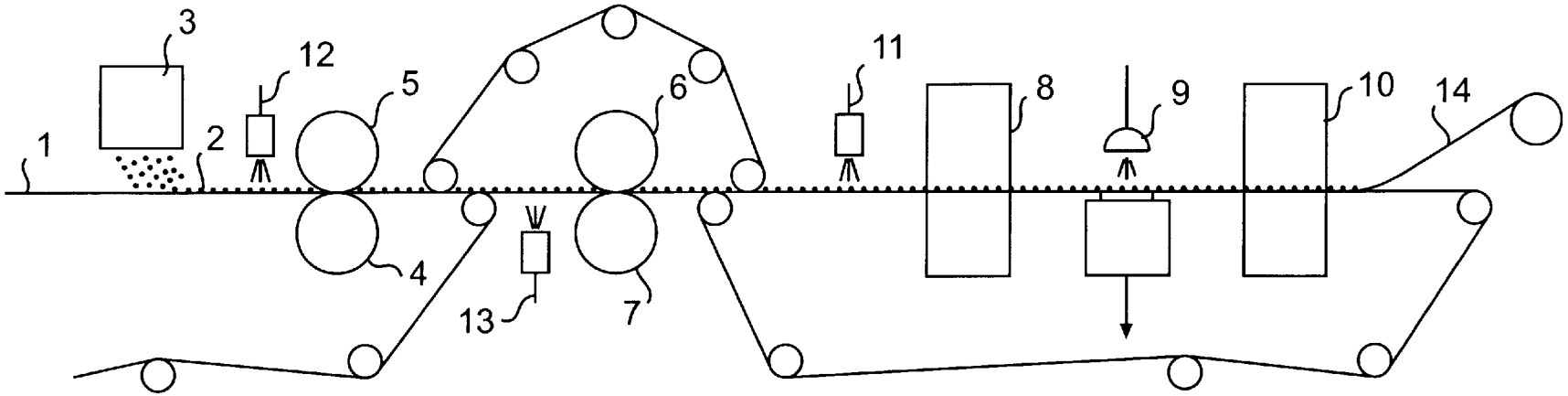

FIG. 1 presents a nonwoven production line where a fibrous web (2) is formed on a wire (1) with the help of a former (3). A blend of fibers and air is blown to the former which extends crosswise over the whole width of the wire, after which the blend is mixed and screened to form a uniform fibrous web on the moving wire (1) underneath according to known techniques. The number of formers used can be selected on the basis of the desired layer thickness and as production require. Layer after layer is formed on the same production line until the desired thickness is achieved. In addition, the proportion of different fibers in different layers can be varied within the frames of the invention. Wood fiber is preferably relatively long-fibered mechanical or chemical pulp, whereas rayon fibers should be staple fibers made of regenerated cellulose. The plastic bonding and/or reenforcing fibers may be of any staple fiber quality suitable for nonwovens, e.g, polyethylene, polypropylene or for instance bicomponent fibers with a core of polypropylene and a sheath of polyethylene. The particle content limits in the fibrous web can be, for example, as follows: Natural fiber such as wood fiber 0% to 100%, plastic fiber 0% to 50%, and rayon fiber 0% to 100% by weight of the fibers in the web. The basis weight of the fibrous web can be, for example, 30 $g/m^2$ to 300 $g/m^2$.

The fibrous web is prebonded with the help of plastic fibers by blending the fiber air blend with 3% to 50% of plastic fibers of thermobonding quality, preferably bicomponent fibers with a core of polypropylene and a sheath of polyethylene. After the forming stage, the upper surface of the fibrous web is calendered with a heated roll (5), and the under side of the web with a heated roll (7), after which the fibrous web is thermobonded in a dryer (8). After prebonding, the fibrous web is spunlaced according to known methods on a bonding station (9) after which the web is dried in a dryer (10).

The fibrous web is prebonded with the help of a liquid bonding agent by applying an aqueous latex binder on the upper surface of the web with a spray manifold (11). The penetration of the latex binder into the web is controlled, for instance, by selecting the composition and pressure of the sprayed binder appropriately to ensure penetration of the binder deep enough. One further way of controlling the penetration of the binder is to use a suction box (not shown) placed opposite the spray manifold on the other side of the web whereby penetration can be controlled by adjusting the vacuum applied by the suction box on the web. After spraying the binder, the water is evaporated and the binder matured and perhaps cured in a dryer (8). Having been bonded on the upper surface, the web can be transferred to another prebonding stage (not shown) where the prebonding process is repeated, this time from the under side of the web. After prebonding, the web is spunlaced according to the known method on a bonding station (9) after which the web is dried in a dryer (10).

The fibrous web is prebonded with the help of moisturizing and thermocalendering by adding moisture on the upper surface of the web with a manifold (12) after which the surface is calendered with a heated roll (5). The under side of the web is correspondingly moisturized with a manifold (13) after which the thermocalendering is performed with a heated roll (7). As a result of moisturizing and thermocalendering, fiber bonds are created that noticeably increase web strength, thus enabling the transfer of the web onto a bonding station (9) where spunlacing is carried out according to the known method.

The nonwoven material (14) is essentially only one seamless layer even though the thickness and composition of the layers can be adjusted and controlled during the forming stage. What is essential is that the layers are formed and the fibrous web prebonded and spunlaced on the same line.

We claim:

1. A method of making a nonwoven material having good absorbency, softness and strength, the method comprising:

air laying a fibrous web from fibers comprising at least one of natural fibers and rayon fibers;

prebonding the web by sequentially adding moisture on an upper surface of the web and on a lower surface of the web, wherein the web is calendered with a heated roll a first time after adding moisture on the upper surface of the web and calendered with a heated roll a second time after adding moisture on the lower surface of the web; and spunlacing the web.

2. The method according to claim 1, wherein the natural fibers are wood fibers.

3. The method according to claim 1, wherein moisture is added on a surface of the web by using a manifold.

4. The method according to claim 1, wherein moisture is added on an upper surface of the web and on a lower surface of the web.

5. The method according to claim 4, wherein the moisture is added on the upper surface of the web and on the lower surface of the web sequentially.

6. The method according to claim 1, wherein the fibrous web is also laid from plastic fibers.

7. The method according to claim 6, wherein the fibrous web is laid up from 0% to 50% plastic fibers by weight of the fibers in the web.

8. The method according to claim 1, wherein the web is laid from up to 100% natural fibers by weight of the fibers in the web and up to 100% rayon fibers by weight of the fibers in the web.

9. The method according to claim 8, wherein the fibrous web is also laid from plastic fibers.

10. The method according to claim 9, wherein the fibrous web is laid up from 0% to 50% plastic fibers by weight of the fibers in the web.

* * * * *